US006560087B1

(12) United States Patent
Zennamo, Jr. et al.

(10) Patent No.: US 6,560,087 B1
(45) Date of Patent: May 6, 2003

(54) ELECTRONIC SIGNAL FILTER WITH SURGE PROTECTION MECHANISM

(75) Inventors: Joseph A. Zennamo, Jr., Skaneateles, NY (US); Joseph N. Maguire, Syracuse, NY (US); William Louise, North Syracuse, NY (US); Dale W. Marland, Erieville, NY (US)

(73) Assignee: Eagle Comtronics, Inc., Clay, NY (US)

( * ) Notice: Subject to any disclaimer, the term of this patent is extended or adjusted under 35 U.S.C. 154(b) by 282 days.

(21) Appl. No.: 09/654,593

(22) Filed: Sep. 1, 2000

(51) Int. Cl.[7] ..... H01C 7/12

(52) U.S. Cl. ..... 361/118; 361/119; 361/117; 361/91.1; 361/88; 333/185; 174/2

(58) Field of Search ..... 361/118, 119, 361/117, 91.1, 88; 333/185; 174/2

(56) References Cited

U.S. PATENT DOCUMENTS 4,451,803 A 5/1984 Holdsworth et al.
4,485,447 A * 11/1984 Ericsson ..... 333/167
5,150,087 A * 9/1992 Yoshie et al. ..... 333/12
5,262,754 A * 11/1993 Collins ..... 338/20
5,768,084 A * 6/1998 Chaudhry et al. ..... 361/113

* cited by examiner

*Primary Examiner*—Brian Sircus
*Assistant Examiner*—Isabel Rodriguez
(74) *Attorney, Agent, or Firm*—Burr & Brown

(57) ABSTRACT

An electronic signal filter is provided that includes a metal housing which has been adapted to be electrically grounded, and a circuit board positioned within the housing. The circuit board includes a first area and a second area, and has an electrically conductive trace formed on a portion of a top surface of the circuit board that provides electrical communication between the first and second areas of the circuit board. The filter further includes a metal shield connected to the housing, located between the first and second areas of the circuit board. The metal shield extends in a direction substantially perpendicular to the plane of the circuit board and has a slot formed therein for receiving the portion of the circuit board on which the electrically conductive trace is formed. The slot is dimensioned to provide a space between the metal shield and the conductive trace. The dimension of the space is selected to shunt current passing through the conductive trace to ground in the event of a voltage surge passing through the filter.

8 Claims, 2 Drawing Sheets

ELECTRONIC SIGNAL FILTER WITH SURGE PROTECTION MECHANISM

FIELD OF THE INVENTION

The invention relates to electronic signal filters that are used to decode or unscramble protected television signals in order to permit reception and also to attenuate/remove portions of the signals to prevent reception. The invention, in particular, relates to electronic CATV filters having the added function of providing voltage surge protection.

BACKGROUND OF THE INVENTION

Tuned filters have been employed for a number of years to decode scrambled or protected television signals in the CATV industry. The prior art filter structure of FIG. 1 is conceptually similar to that disclosed in U.S. Pat. No. 4,451,803, herein incorporated by reference in its entirety, which discloses a split tuning filter in which at least two separate electrically interconnected filter sections 102 and 103 mounted on a common circuit board 100 are magnetically isolated through an isolation area defined by a pair of spaced isolation shields 104 and 105. A more detailed view of slot 104, 105 is shown in FIG. 2. A slot 106 is formed in each shield, to allow the remaining, unslotted portion of the shield 104 to slide into the corresponding slot 101 formed in the circuit board 100. A conductor (not shown) interconnecting the two filter sections 102 and 103 passes through the isolation area around the shields along the circuit board 100.

In the past, slot 106 has been spaced a relatively large distance from the conductor on the circuit board to prevent shorting between the conductor and the grounded metal shield.

CATV providers have recently demanded surge protection along cable lines that deliver service to subscribers. While discrete surge protection components could be incorporated on the cable line itself, these extra components are themselves costly to produce and install. This increases the expense associated with adding such components, and also increases installation time.

Another possibility would be to add discrete surge protection components within the filter housing itself. However, this would increase the filter manufacturing time and expense, resulting in an overall increase in the cost of CATV filters.

It would be desirable to use the existing components of filter structures to provide the required surge protection in the cable line. No such device exists in the industry.

SUMMARY OF THE INVENTION

It is an object of the present invention to overcome the drawbacks of the prior art, particularly to provide a filter structure for use in the coaxial cable industry which incorporates the function of voltage surge protection without necessitating additional components.

In accordance with one object of the present invention, an electronic signal filter is provided that includes a metal housing which has been adapted to be electrically grounded, and a circuit board positioned within the housing. The circuit board comprises a first area and a second area, and an electrically conductive trace formed on a portion of a top surface of the circuit board providing electrical communication between the first and second areas of the circuit board. The filter further includes a metal shield connected to the housing, located between the first and second areas of the circuit board, and extending in a direction substantially perpendicular to the plane of the circuit board. The shield includes a slot formed therein for receiving the portion of the circuit board on which the electrically conductive trace is formed. The slot is specifically dimensioned to provide a space between the metal shield and the conductive trace. The dimension of the space is selected to shunt current passing through the conductive trace to the grounded shield in the event of a voltage surge passing through the filter.

In accordance with another embodiment of the present invention, a slot in the metal shield is provided having a first section in intimate contact with said circuit board, and having a second section further providing a space between the top surface of the circuit board and the slot. The first section helps hold the shield in place on the circuit board, and the second section defines the space used to shunt current passing through the conductive trace to ground in the event of a voltage surge passing through the filter.

In accordance with yet another embodiment of the present invention, the slot is provided with a third section further defining another space positioned below the circuit board. An electrically conductive plated through-hole is also provided in the circuit board, extending from the electrically conductive trace and passing through the circuit board in the region of the metal shield. An electrically conductive contact pad is positioned on a bottom surface of the circuit board such that it is in electrical communication with the electrically conductive plated through-hole. This provides current shunting spaces above and below the circuit board, thus providing an added level of voltage surge protection reliability.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
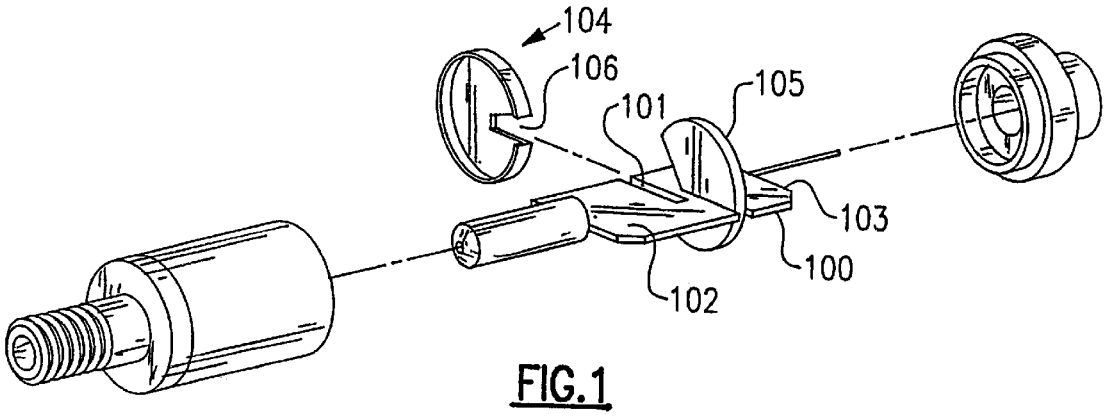
FIG.1 Prior Art
FIG. 1 is a view of a prior art CATV filter.
Figure 2:
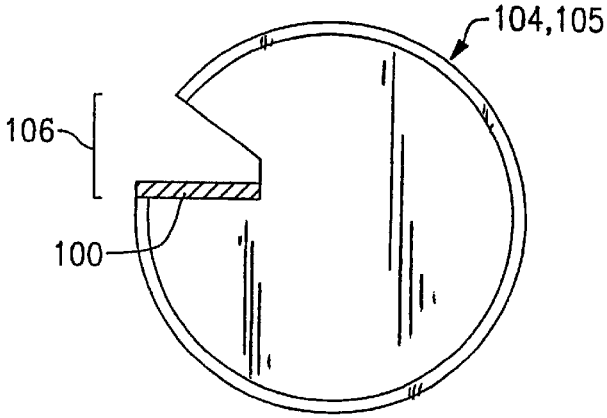
FIG.2 Prior Art
FIG. 2 is a cross sectional view of the metal shield of the prior art CATV filter shown in FIG. 1.
Figure 3A:
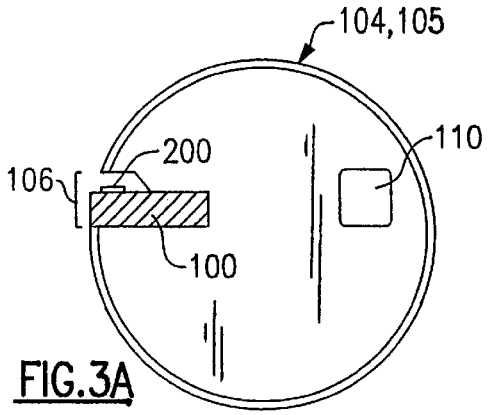
FIG. 3A is a cross sectional view of a metal shield of a filter in accordance with one embodiment of the present invention.
Figure 4:
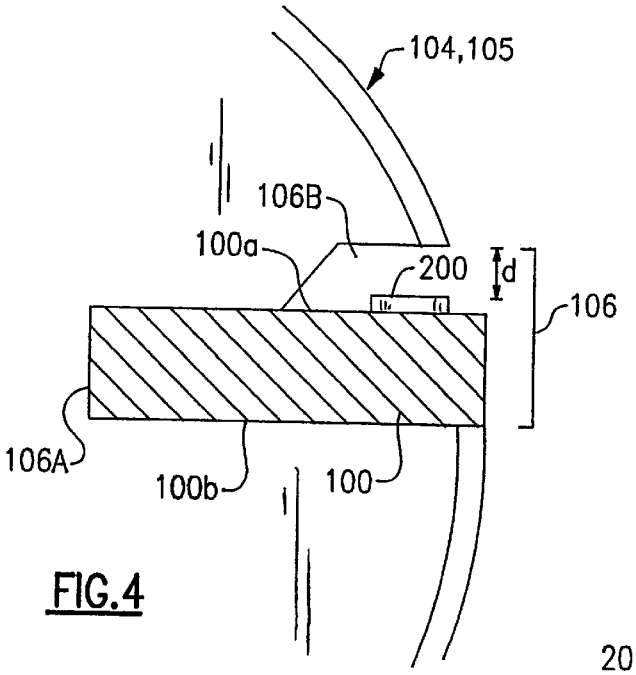
FIG. 4 is a partial cut-out view of the metal shield of the filter in accordance with the embodiment of the present invention as shown in FIG. 3A.

FIG. 3A, read in connection with the corresponding view shown in FIG. 4, is a cross sectional view of a metal shield of a filter in accordance with one embodiment of the present invention. The grounded metal shield 104 (or 105 as shown in FIG. 1) includes a slot 106. The slot 106 includes a first section 106A, providing intimate contact with bottom surface 100*b* of circuit board 100 and with a portion of top surface 100*a* of circuit board 100.

Slot 106 further includes a second section 106B defining a space between the top surface 100*a* of circuit board 100 and shield 104. A conductive trace 200 is positioned on top surface 100*a* of circuit board 100 within second section 106B of slot 106. A space of dimension d is formed between the surface of conductive trace 200 and the top of slot 106 in the region of 106B. The dimension d of the space relates to the dielectric constant of the material, or air, located within the space. If a voltage surge passes through the filter along conductive trace 200, a spark is generated within the space, and the current is shunted to ground via the grounded metal shield 104.

It is believed that a space having the dimension d of about 0.013 inches will spark at a voltage surge of about 1000 volts passing through the conductive trace. Accordingly, d should be selected within a range of about 0.010 to 0.020 inches to provide a 1000–2000V surge protection rating.

FIG. 3A also shows that the metal shield preferably includes a raised boss member 110, which increases the effective thickness of the metal shield to more closely match the width of the shield-receiving slot 101(FIG. 1) cut through the circuit board 100. It is difficult to cut a slot through the circuit board that matches the relatively small thickness of the metal shield.

The metal shield 104 is made from a conductive metal, such as tin plated steel, which is grounded to the housing of the filter. The circuit board 100 is made from an electrically insulating material, an example of which is glass-epoxy composite. The conductive trace 200 is made from a conductive material, an example of which is solder-covered copper.

Figure 3B:
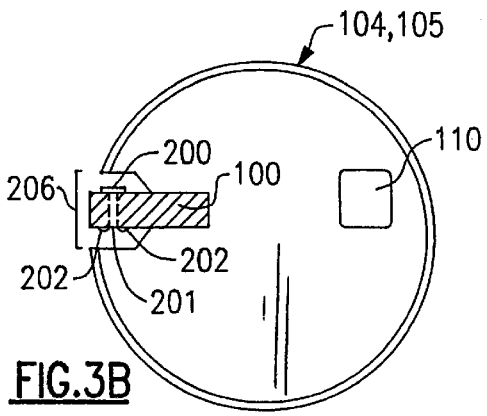
FIG. 3B is a cross sectional view of the metal shield of the filter in accordance with another embodiment of the present invention.
Figure 5:
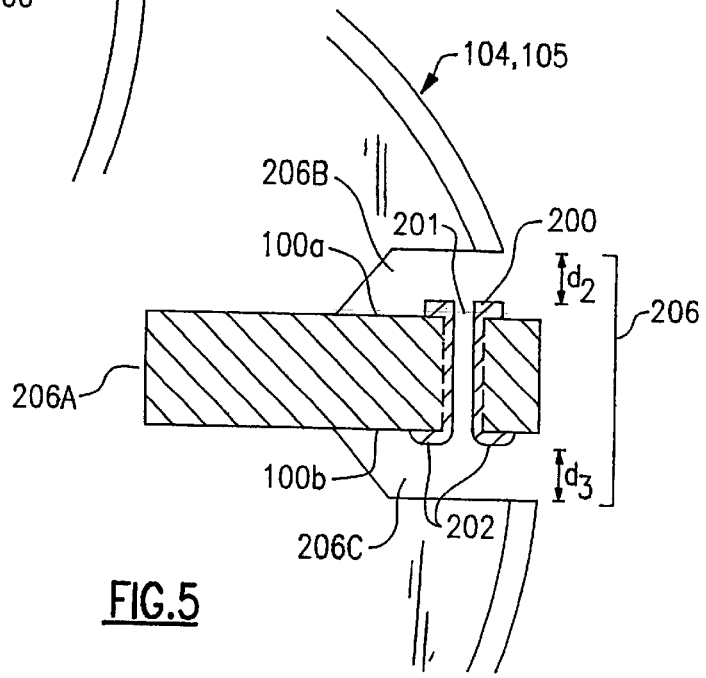
FIG. 5 is a partial cut-out view of the metal shield of a CATV filter in accordance with another embodiment of the present invention as shown in FIG. 3B.

FIG. 3B, read in connection with the corresponding view shown in FIG. 5, is a cross sectional view of the metal shield of a filter in accordance with another embodiment of the present invention. The metal shield 104 (or 105 as shown in FIG. 1) includes a slot 206. Slot 206 includes a first section 206A, providing intimate contact with a portion of bottom surface 100*b* of circuit board 100 and a portion of top surface 100*a* of circuit board 100.

Slot 206 also includes a second section 206B defining a space between top surface 100*a* of circuit board 100 and shield 104. Slot 206 further includes a third section 206C defining a space between bottom surface 100*b* of circuit board 100 and shield 104.

A conductive trace 200 is located on top surface 100*a* of the circuit board 100 within the second section 206B. A space of dimension $d_2$ is formed between the surface of the conductive trace 200 and slot 206 in the region of 206B. An electrically conductive plated through-hole 201 passes from the top of conductive trace 200, through circuit board 100, and through a conductive contact pad 202 located on bottom surface 100*b* of circuit board 100. A space having the dimension $d_3$ is formed between the surface of conductive contact pad 202 and slot 206 in the region of 206C.

The dimensions of the spaces $d_2$ and $d_3$ relate to the dielectric constant of the material, or air, located within the respective spaces. If a voltage surge passes through the filter along conductive trace 200, a spark is generated within the space, and the current is shunted to ground via the grounded metal shield 104. The through-hole 201 is plated with a conductive material, an example of which is copper.

It is believed that a space having the dimension $d_2$ (or $d_3$) of about 0.013 inches will spark at a voltage surge of about 1000 volts passing through the conductive trace. Accordingly, $d_2$ (or $d_3$) should be selected within a range of about 0.010 to 0.020 inches to provide a 1000–2000V surge protection rating.

FIG. 3B also shows that metal shield 104 preferably includes a raised boss member 110, which increases the effective thickness of the metal shield to more closely match the width of the shield-receiving slot 101 (FIG. 1) cut through the circuit board 100.

Although not shown in the present drawings, the interior of the housing can be filled with a potting compound, such as polyurethane foam.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. An electronic signal filter comprising:

a metal housing adapted to be electrically grounded;

a circuit board positioned within said housing, having a first area and a second area;

an electrically conductive trace formed on a portion of a top surface of said circuit board providing electrical communication between said first and second areas of said circuit board; and a metal shield connected to said housing, in a position between said first and second areas of said circuit board, said metal shield extending in a direction substantially perpendicular to the plane of the circuit board and having a slot formed therein for receiving said portion of said circuit board on which said electrically conductive trace is formed, said slot being dimensioned to provide a space between said metal shield and said conductive trace, wherein the dimension of said space is selected to shunt current passing through said conductive trace to ground in the event of a voltage surge passing through the filter.

2. The filter of claim 1, wherein said slot comprises a first section in intimate contact with said circuit board, and a second section defining said space.

3. The filter of claim 2, wherein said slot further comprises a third section defining another space positioned below said circuit board.

4. The filter of claim 3, further comprising an electrically conductive plated through-hole extending from said electrically conductive trace and passing through said circuit board in the region of said metal shield, and an electrically conductive contact pad positioned on a bottom surface of said circuit board in electrical communication with said electrically conductive plated through-hole.

5. The filter of claim 3, wherein said other space has a dimension ranging from about 0.010 inches to 0.020 inches.

6. The filter of claim 1, wherein said space has a dimension ranging from about 0.010 inches to 0.020 inches.

7. The filter of claim 1, wherein said metal shield further comprises a raised boss member aligned laterally with said slot, for increasing the effective thickness of said metal shield.

8. The filter of claim 1, further comprising a foam material filling the interior of said metal housing.

* * * * *